US009373293B2

(12) United States Patent
Hsu

(10) Patent No.: US 9,373,293 B2
(45) Date of Patent: Jun. 21, 2016

(54) DISPLAY PANEL AND DISPLAY APPARATUS

(71) Applicant: Novatek Microelectronics Corp., Hsinchu (TW)

(72) Inventor: Chin-Hung Hsu, Taoyuan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 175 days.

(21) Appl. No.: 13/962,963

(22) Filed: Aug. 9, 2013

(65) Prior Publication Data

US 2014/0132588 A1 May 15, 2014

(30) Foreign Application Priority Data

Nov. 12, 2012 (TW) ..... 101142072 A

(51) Int. Cl.
*G09G 3/36* (2006.01)

(52) U.S. Cl.
CPC ..... *G09G 3/3614* (2013.01); *G09G 3/3648* (2013.01); *G09G 3/3677* (2013.01)

(58) Field of Classification Search
None
See application file for complete search history.

(56) References Cited

U.S. PATENT DOCUMENTS 6,456,267 B1 * 9/2002 Sato ..... G09G 3/3659 345/204
2007/0211006 A1 * 9/2007 Lee ..... G09G 3/211 345/89
2008/0246712 A1 * 10/2008 Cavallini ..... G09G 3/3685 345/89
2009/0167660 A1 * 7/2009 Wang ..... G09G 3/3637 345/89
2009/0244041 A1 * 10/2009 Choe ..... G09G 3/3659 345/211
2012/0050147 A1 * 3/2012 Iwasa ..... G09G 3/3614 345/96
2012/0249512 A1 10/2012 Ohhashi et al.
2012/0268446 A1 * 10/2012 Yamauchi ..... G09G 3/3659 345/212

FOREIGN PATENT DOCUMENTS

CN 102376274 3/2012
JP 09-311667 12/1997
JP 2002-169181 6/2002

(Continued)

OTHER PUBLICATIONS

"Office Action of Taiwan Counterpart Application", issued on Jun. 27, 2014, p. 1-p. 10.

(Continued)

*Primary Examiner* — Kathy Wang-Hurst
*Assistant Examiner* — Douglas M Wilson
(74) *Attorney, Agent, or Firm* — Jianq Chyun IP Office

(57) ABSTRACT

A display apparatus includes a source driver and a display panel. The source driver provides a plurality of pixel voltages which respectively correspond to a maximum gray-level voltage or a minimum gray-level voltage. The display panel includes a plurality of data lines, a plurality of pixel switches, a plurality of pixel capacitors, and a plurality of gray-level switches. The data lines are coupled to the source driver to receive the pixel voltages. Each pixel switch is respectively coupled to the corresponding data line to transmit the corresponding pixel voltage. Each pixel capacitor is respectively coupled between the corresponding pixel switch and a common voltage to receive the corresponding pixel voltage. Each gray-level switch is respectively coupled to the corresponding pixel capacitor in parallel and respectively receives a gray-level control signal. The gray-level switches regulate voltage drops across the pixel capacitors according to the corresponding gray-level control signals.

28 Claims, 6 Drawing Sheets

(56) References Cited

FOREIGN PATENT DOCUMENTS

| | | |
|---|---|---|
| TW | 200530985 | 9/2005 |
| TW | 201207799 | 2/2012 |

OTHER PUBLICATIONS

"Office Action of Chinese Counterpart Application", issued on Aug. 6, 2015, p. 1-p. 6.

* cited by examiner

DISPLAY PANEL AND DISPLAY APPARATUS

CROSS-REFERENCE TO RELATED APPLICATION

This application claims the priority benefit of Taiwan application serial no. 101142072, filed on Nov. 12, 2012. The entirety of the above-mentioned patent application is hereby incorporated by reference herein and made a part of this specification.

BACKGROUND OF THE INVENTION

1. Technical Field

The invention relates to a display panel and a display apparatus having the same, and more particularly to a display panel and a display apparatus having the same capable of reducing power consumption.

2. Description of Related Art

In recent years, flat panel displays, such as liquid crystal displays (LCDs), have enjoyed burgeoning development. Due to numerous advantages of the LCD, such as low power consumption, free of radiation, and high space utilization, the LCD has gradually become one of the main stream products on the market. An LCD includes a source driver and an LCD panel. The source driver sequentially provides a plurality of pixel voltages to the LCD panel, so as to drive the LCD panel to display images. The voltage level of each pixel voltage provided by the source driver may be changed in response to the image to be displayed.

Generally, when the source driver raises the voltage levels of the pixel voltages provided by the source driver (i.e., when the source driver charges an output terminal), the power consumption of the source driver significantly increases. In order to satisfy the requirement for reducing the power consumption of the LCD, how to decrease the amplitude of variation in the pixel voltages as well as reduce the numbers of variations has become one of the focuses on designing the LCD.

SUMMARY OF THE INVENTION

An embodiment of the invention is directed to a display apparatus capable of reducing power consumption of a source driver in the display apparatus.

In an embodiment of the invention, a display apparatus that includes a source driver and a display panel is provided. The source driver provides a plurality of pixel voltages which respectively correspond to a maximum gray-level voltage or a minimum gray-level voltage. The display panel includes a plurality of data lines, a plurality of pixel switches, a plurality of pixel capacitors, and a plurality of gray-level switches. The data lines are coupled to the source driver to receive the pixel voltages. Each pixel switch is respectively coupled to the corresponding data line to transmit the corresponding pixel voltage. Each pixel capacitor is respectively coupled between the corresponding pixel switch and a common voltage to receive the corresponding pixel voltage. Each gray-level switch is respectively coupled to the corresponding pixel capacitor in parallel and respectively receives a gray-level control signal. The gray-level switches regulate voltage drops across the pixel capacitors coupled to the gray-level switches according to the corresponding gray-level control signals.

According to an embodiment of the invention, each of the gray-level control signals is enabled by a target pixel voltage of the corresponding pixel capacitor, and the target pixel voltage ranges between the maximum gray-level voltage and the common voltage or between the minimum gray-level voltage and the common voltage.

According to an embodiment of the invention, adjustment amplitude of each of the voltage drops across the pixel capacitors is determined by a voltage level and an enabling period of the corresponding gray-level control signal.

In an embodiment of the invention, a display apparatus that includes a timing controller, a source driver, and a display panel is provided. The timing controller outputs a source data latch signal. The source driver is coupled to the timing controller. According to the source data latch signal, the source driver provides a plurality of pixel voltages respectively corresponding to a maximum gray-level voltage or a minimum gray-level voltage. The display panel includes a plurality of data lines, a plurality of pixel switches, a plurality of pixel capacitors, and a plurality of gray-level switches. The data lines are coupled to the source driver to receive the pixel voltages. Each pixel switch is respectively coupled to the corresponding data line to transmit the corresponding pixel voltage. Each pixel capacitor is respectively coupled between the corresponding pixel switch and a common voltage to receive the corresponding pixel voltage. Each gray-level switch is respectively coupled to the corresponding pixel capacitor in parallel and respectively receives a gray-level control signal. The gray-level switches regulate voltage drops across the pixel capacitors coupled to the gray-level switches according to the corresponding gray-level control signals.

According to an embodiment of the invention, the display apparatus further includes a gate driver coupled to the timing controller. The gate driver is controlled by the timing controller to provide a plurality of gate driving signals, so as to drive the pixel switches row by row to transmit the corresponding pixel voltages, and the gate driver is controlled by the timing controller to provide the gray-level control signals.

According to an embodiment of the invention, the display panel further includes a plurality of scan lines respectively coupled between the gate driver and the pixel switches, so as to respectively transmit the gate driving signals to the pixel switches.

According to an embodiment of the invention, the gray-level control signals received by the gray-level switches corresponding to the same one of the scan lines correspond to a first gray-level control signal.

According to an embodiment of the invention, when target pixel voltages of the pixel capacitors corresponding to the same one of the scan lines all range between the maximum gray-level voltage and the common voltage or between the minimum gray-level voltage and the common voltage, the timing controller controls the gate driver to enable the first gray-level control signal of the gray-level switches corresponding to the current one of the scan lines.

According to an embodiment of the invention, the first gray-level control signal of the gray-level switches corresponding to the current one of the scan lines is enabled in a scan period corresponding to a next one of the scan lines.

According to an embodiment of the invention, adjustment amplitude of the voltage drops across the pixel capacitors corresponding to the current one of the scan lines is determined by a voltage level and an enabling period of the corresponding first gray-level control signal.

According to an embodiment of the invention, the gate driver enables the first gray-level control signals according to a first switch enabling signal provided by the timing controller.

According to an embodiment of the invention, the gray-level control signals received by odd-numbered gray-level switches of the gray-level switches corresponding to the same one of the scan lines correspond to a second gray-level control signal, and the gray-level control signals received by even-numbered gray-level switches of the gray-level switches corresponding to the same one of the scan lines correspond to a third gray-level control signal.

According to an embodiment of the invention, when target pixel voltages of odd-numbered pixel capacitors of the pixel capacitors corresponding to the same one of the scan lines all range between the maximum gray-level voltage and the common voltage or between the minimum gray-level voltage and the common voltage, the timing controller controls the gate driver to enable the second gray-level control signal of the odd-numbered gray-level switches corresponding to the current one of the scan lines.

According to an embodiment of the invention, the second gray-level control signal of the odd-numbered gray-level switches corresponding to the current one of the scan lines are enabled in a scan period corresponding to a next one of the scan lines.

According to an embodiment of the invention, adjustment amplitude of the voltage drops across the odd-numbered pixel capacitors corresponding to the same one of the scan lines is determined by a voltage level and an enabling period of the corresponding second gray-level control signal.

According to an embodiment of the invention, the gate driver enables the second gray-level control signals according to a second switch enabling signal provided by the timing controller.

According to an embodiment of the invention, when target pixel voltages of even-numbered pixel capacitors of the pixel capacitors corresponding to the same one of the scan lines all range between the maximum gray-level voltage and the common voltage or between the minimum gray-level voltage and the common voltage, the timing controller controls the gate driver to enable the third gray-level control signal of the even-numbered gray-level switches corresponding to the current one of the scan lines.

According to an embodiment of the invention, the third gray-level control signal of the even-numbered gray-level switches corresponding to the current one of the scan lines are enabled in a scan period corresponding to a next one of the scan lines.

According to an embodiment of the invention, adjustment amplitude of the voltage drops across the even-numbered pixel capacitors corresponding to the same one of the scan lines is determined by a voltage level and an enabling period of the corresponding third gray-level control signal.

According to an embodiment of the invention, the gate driver enables the third gray-level control signals according to a third switch enabling signal provided by the timing controller.

According to an embodiment of the invention, the gate driver sequentially provides the gate driving signals according a start signal, a gate clock signal, and an output enabling signal provided by the timing controller.

According to an embodiment of the invention, the pixel switches and the gray-level switches are transistors.

In an embodiment of the invention, a display panel is disclosed, comprising a plurality of data lines, a plurality of pixel switches, each of the pixel switches being respectively coupled to a corresponding data line of the data lines, a plurality of pixel capacitors, each of the pixel capacitors being respectively coupled between a corresponding pixel switch of the pixel switches and a common voltage, and a plurality of gray-level switches, each of the gray-level switches being respectively coupled to a corresponding pixel capacitor of the pixel capacitors in parallel.

In view of the above, each pixel capacitor in the display apparatus described in an embodiment of the invention is coupled to one gray-level switch in parallel, and each gray-level switch is controlled by the corresponding gray-level control signal and is turned on. Thereby, the voltage levels stored by the pixel capacitors coupled to the gray-level switches may be adjusted. Namely, the voltage levels stored by the pixel capacitors may be adjusted according to whether the gray-level switches coupled to the pixel capacitors in parallel are turned on or not. Besides, the pixel voltages provided by the source driver may be kept to be the maximum gray-level voltage or the minimum gray-level voltage, so as to reduce the power consumption of the source driver and further reduce the power consumption of the display apparatus.

In order to make the aforementioned and other features and advantages of the invention comprehensible, embodiments accompanied with figures are described in detail below.

BRIEF DESCRIPTION OF THE DRAWINGS

Reference will now be made in detail to the present preferred embodiments of the invention, examples of which are illustrated in the accompanying drawings. Wherever possible, the same reference numbers are used in the drawings and the description to refer to the same or like parts.

DETAILED DESCRIPTION OF DISCLOSED EMBODIMENTS

Figure 1A:
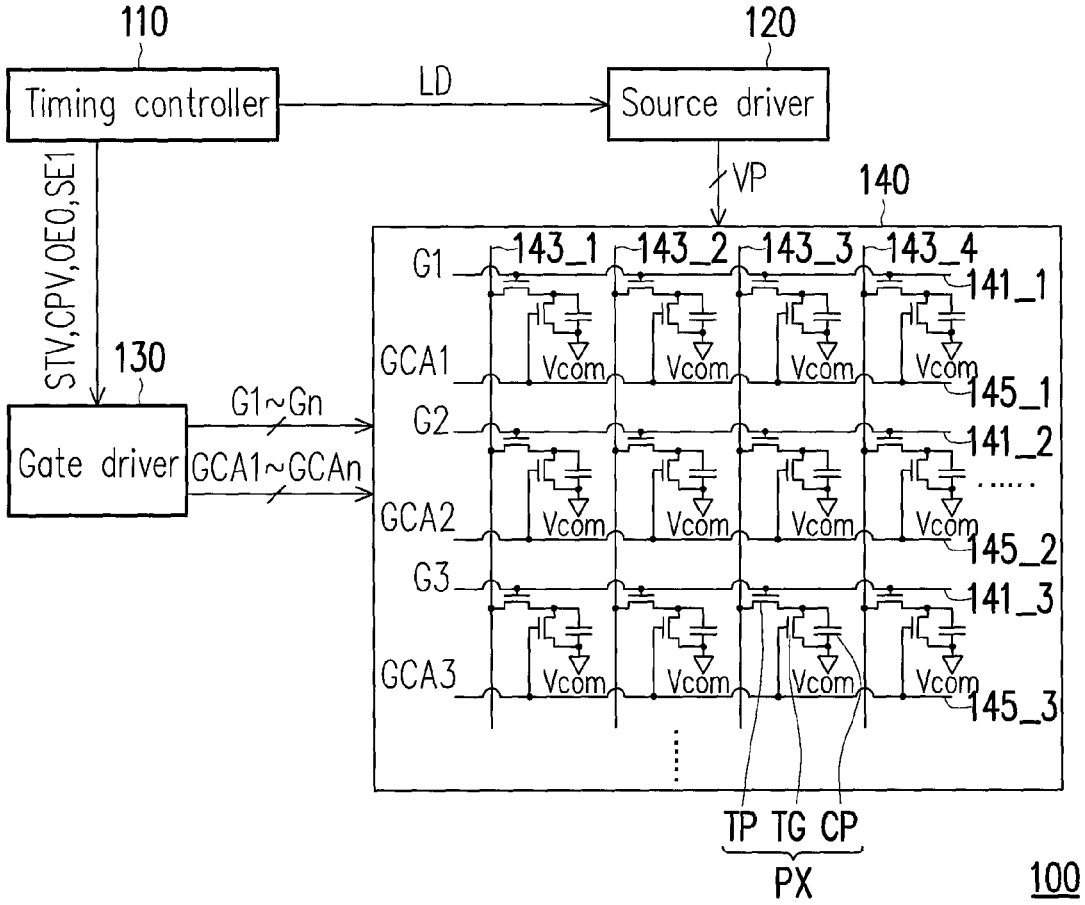
FIG. 1A is a systematic diagram schematically illustrating a display apparatus according to an embodiment of the invention.

FIG. 1A is a systematic diagram schematically illustrating a display apparatus according to an embodiment of the invention. With reference to FIG. 1A, in the present embodiment, the display apparatus 100 includes a timing controller 110, a source driver 120, a gate driver 130, and a display panel 140. According to the present embodiment, the display panel 140 is a normal-black liquid crystal display (LCD) panel, for instance, which should not be construed as a limitation to this invention.

The source driver 120 is coupled to the timing controller 110 and the display panel 140. According to a source data latch signal LD provided by the timing controller 110, the source driver 120 provides a plurality of pixel voltages VP to the display panel 140, and each of the pixel voltages VP respectively corresponds to a maximum gray-level voltage or a minimum gray-level voltage. In an exemplary normal-black LCD panel, the maximum gray-level voltage and the minimum gray-level voltage are a positive gray-level voltage and a negative gray-level voltage corresponding to the maximum gray-level value and are applied for controlling the display panel 140 to display images with the maximum brightness (e.g., the maximum gray-level value). A voltage difference between the maximum gray-level voltage and a common voltage Vcom is substantially the same as a voltage difference between the minimum gray-scale voltage and the common voltage Vcom, and the common voltage Vcom ranges between the maximum gray-level voltage and the minimum gray-scale voltage.

In the present embodiment, the source driver 120 is suitable for driving the display panel 140 through column inversion or frame inversion. That is, during one frame period, all of the pixel voltages VP are the maximum gray-level voltage or the minimum gray-level voltage, or the pixel voltages VP may alternatively be the maximum gray-level voltage and the minimum gray-level voltage.

The gate driver 130 is coupled to the timing controller 110 and the display panel 140. Besides, the gate driver 130 is controlled by a start signal STV, a gate clock signal CPV, and an output enabling signal OEO provided by the timing controller 110 to provide a plurality of gate driving signals G1 to Gn to the display panel 140, and the gate driver 130 is also controlled by the start signal STV, the gate clock signal CPV, and a first switch enabling signal SE1 provided by the timing controller 110 to provide a plurality of first gray-level control signals GCA1 to GCAn. Here, n is a positive integer. The start signal STV serves to control the gate driver 130 to start outputting the gate driving signals G1 to Gn and the first gray-level control signals GCA1 to GCAn; according to the gate clock signal CPV, the gate driver 130 sets the corresponding gate driving signal (e.g., G1 to Gn) with the current and the corresponding first gray-level control signal (e.g., GCA1 to GCAn) with the current; according to the output enabling signal OEO, the gate driver 130 sets the waveform of the corresponding gate driving signal (e.g., G1 to Gn); according to the first switch enabling signal SE1, the gate driver 130 sets the waveform of the corresponding first gray-level control signal (e.g., GCA1 to GCAn) with the current.

The display panel 140 includes a plurality of scan lines (e.g., 141_1 to 141_3), a plurality of data lines (e.g., 143_1 to 143_4), a plurality of first gray-level control lines (e.g., 145_1 to 145_3), and a plurality of pixel units PX arranged in arrays. The scan lines (e.g., 141_1 to 141_3) are coupled to the gate driver 130, so as to respectively receive the corresponding gate driving signals (e.g., G1 to Gn); for instance, the scan line 141_1 receives the gate driving signal G1, the scan line 141_2 receives the gate driving signal G2, and so forth. The data lines (e.g., 143_1 to 143_4) are coupled to the source driver 120 to respectively receive the corresponding pixel voltages VP. The first gray-level control lines (e.g., 145_1 to 145_3) are coupled to the gate driver 130, so as to respectively receive the corresponding first gray-level control signals (e.g., GCA1 to GCAn); for instance, the first gray-level control line 145_1 receives the first gray-level control signal GCA1, the first gray-level control line 145_2 receives the first gray-level control signal GCA2, and so forth.

Each of the pixel units PX has a pixel switch (e.g., a transistor TP), a pixel capacitor CP, and a gray-level switch (e.g., a transistor TG), for instance. In each pixel unit PX, the source of the transistor TP is coupled to the corresponding data line (e.g., 143_1 to 143_4), so as to receive the corresponding pixel voltage VP; the gate of the transistor TP is coupled to the corresponding scan line (e.g., 141_1 to 141_3), so as to receive the corresponding gate driving signal (e.g., G1 to Gn); the drain of the transistor TP is coupled to the pixel capacitor CP. The pixel capacitor CP is coupled between the drain of the transistor TP and the common voltage Vcom. The source and the drain of the transistor TG are respectively coupled to two ends of the pixel capacitor CP in parallel; the gate of the transistor TG is coupled to the corresponding first gray-level control line (e.g., 145_1 to 145_3), so as to receive the corresponding first gray-level control signal (e.g., GCA1 to GCAn).

When each of the transistors TP is controlled by the corresponding gate driving signal (e.g., G1 to Gn) and is thereby turned on, the corresponding pixel voltage VP is applied to the pixel capacitor CP, and the pixel capacitor CP performs a charging/discharging function according to the corresponding pixel voltage VP and thus changes the voltage drop across the pixel capacitor CP. Besides, when each of the transistors TG is controlled by the corresponding first gray-level control signal (e.g., GCA1 to GCAn) and is then turned on, the voltage drop across the pixel capacitor CP which is connected to the turned-on transistor TG in parallel may be reduced, and thereby the brightness (i.e., the gray-level value) displayed by the pixel units PX may be affected.

In the present embodiment, the gates of the transistors TG of the pixel units PX corresponding to the same scan line (e.g., 141_1 to 141_3) are coupled to the same first gray-level control line (e.g., 145_1 to 145_3); therefore, the gates of the transistors TG of the pixel units PX corresponding to the same scan line (e.g., 141_1 to 141_3) receive the same first gray-level control signal (e.g., GCA1 to GCAn). For instance, the gates of the transistors TG of the pixel units PX corresponding to the scan line 141_1 are coupled to the first gray-level control line 145_1 to receive the first gray-level control signal GCA1, the gates of the transistors TG of the pixel units PX corresponding to the scan line 141_2 are coupled to the first gray-level control line 145_2 to receive the first gray-level control signal GCA2, and so forth. Thereby, the brightness displayed by the pixel units PX corresponding to the same scan line (e.g., 141_1~141_3) is controlled by the same first gray-level control signal (e.g., GCA1 to GCAn) and will be adjusted at the same time; that is, in the present embodiment, the pixel units PX corresponding to the same one of the scan lines (e.g., 141_1~141_3) serve as a unit of brightness adjustment.

Figure 1B:
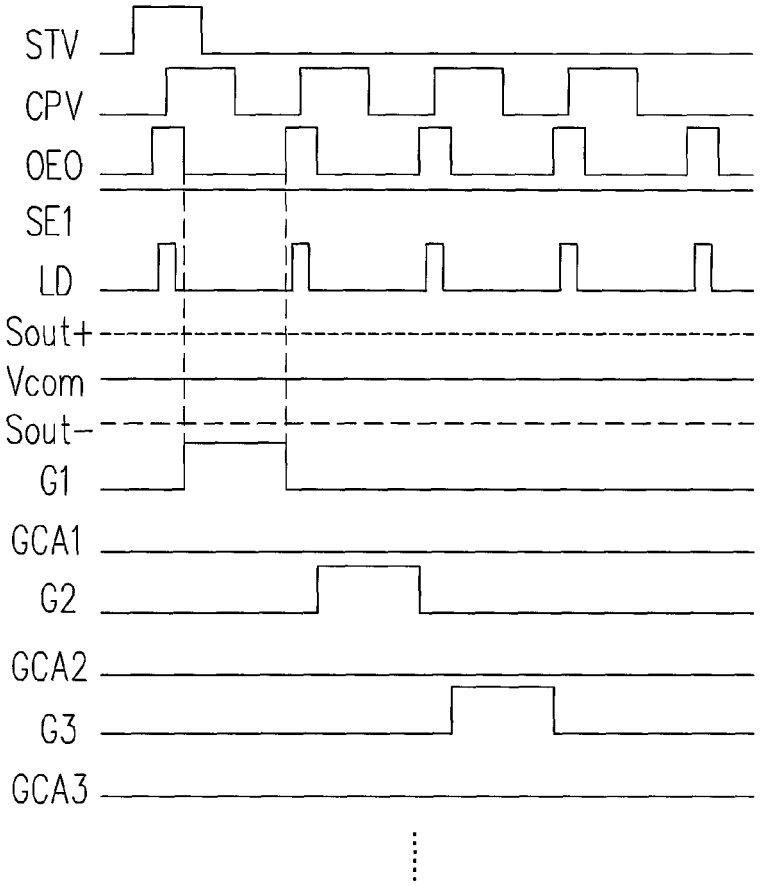
FIG. 1B is a schematic diagram illustrating a driving waveform of the display apparatus depicted in FIG. 1A according to an embodiment of the invention.
Figure 1C:
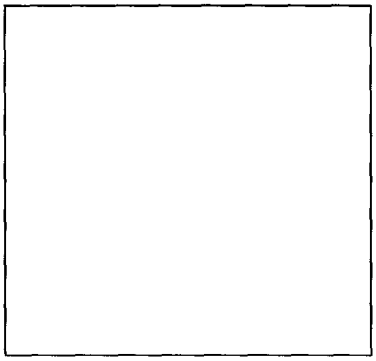
FIG. 1C is a schematic diagram illustrating the displayed image in FIG. 1B.

FIG. 1B is a schematic diagram illustrating a driving waveform of the display apparatus depicted in FIG. 1A according to an embodiment of the invention. FIG. 1C is a schematic diagram illustrating the displayed image in FIG. 1B. With reference to FIG. 1A, FIG. 1B, and FIG. 1C, in the present embodiment, the image to be displayed is assumed to be a fully white image, i.e., all of the pixel units PX have the maximum displayed brightness (the maximum gray-level value). Since each pixel voltage VP provided by the source driver 120 corresponds to the maximum gray-level voltage Sout+ or the minimum gray-level voltage Sout− (i.e., the positive gray-level voltage or the negative gray-level voltage with the maximum gray-level value), all the pixel units PX spontaneously display the maximum brightness, given that the brightness (i.e., the gray-level value) of the pixel units PX is not adjusted herein. That is, it is not necessary to adjust the brightness (i.e., the gray-level value) according to the present embodiment. Here, the common voltage Vcom ranges between the maximum gray-level voltage Sout+ and the minimum gray-level voltage Sout−, and the source driver 120 outputs the pixel voltages VP according to the positive pulse of the source data latch signal LD.

To be specific, when the start signal STV forms the positive pulse, the gate driver 130 prepares to output the gate driving signals G1 to Gn and determines the gate driving signal (e.g., G1 to Gn) to be set according to the positive edge of the clock signal CPV. For instance, when the waveform of the gate driving signal G1 is to be set according to the positive edge of the clock signal CPV, the gate driver 130 sets the waveform of the gate driving signal G1 according to the output enabling signal OEO. That is, when the voltage level of the output enabling signal OEO is high, the voltage level of the gate driving signal G1 is set to be low; when the voltage level of the output enabling signal OEO is low, the voltage level of the gate driving signal G1 is set to be high. When the waveform of the gate driving signal G2 is to be set according to the positive edge of the clock signal CPV, the gate driver 130 sets the waveform of the gate driving signal G2 according to the output enabling signal OEO. Other waveform settings may be deduced from the above and thus will not be further explained. Thereby, the gate driving signals G1 to Gn are sequentially enabled (e.g., at the high voltage level), such that the transistors TP of the pixel units PX are driven row by row to transmit the corresponding pixel voltages VP.

Similar to the above, when the start signal STV forms the positive pulse, the gate driver 130 prepares to output the first gray-level control signals GCA1 to GCAn and determines the first gray-level control signal (e.g., GCA1 to GCAn) to be set according to the positive edge of the clock signal CPV. In the present embodiment, it is not necessary to adjust the brightness (i.e., the gray-level value); therefore, the first switch enabling signal SE1 stays at the high voltage level in the present embodiment, and thus the first gray-level control signals GCA1 to GCAn do not forms the positive pulse (i.e., the first gray-level control signals GCA1 to GCAn are not enabled).

Figure 1D:
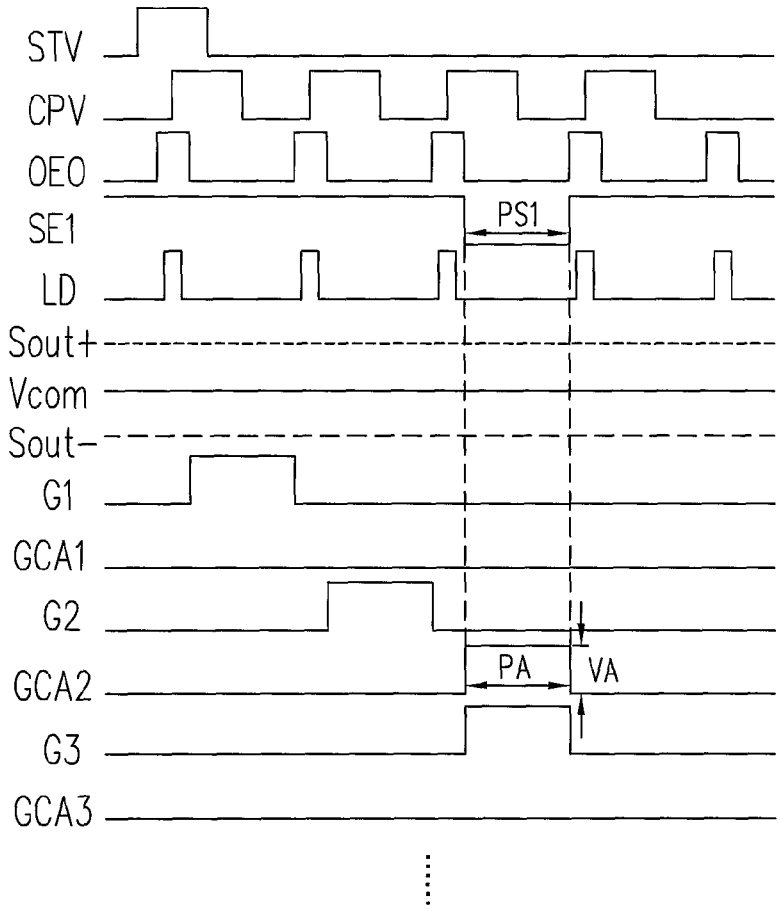
FIG. 1D is a schematic diagram illustrating a driving waveform of the display apparatus depicted in FIG. 1A according to another embodiment of the invention.
Figure 1E:
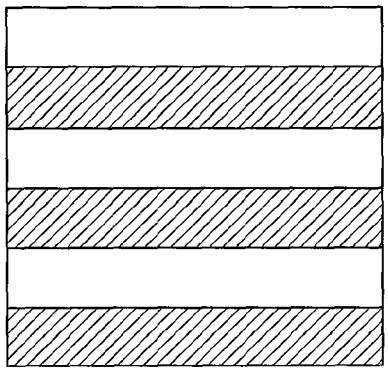
FIG. 1E is a schematic diagram illustrating the displayed image in FIG. 1D.

FIG. 1D is a schematic diagram illustrating a driving waveform of the display apparatus depicted in FIG. 1A according to another embodiment of the invention. FIG. 1E is a schematic diagram illustrating the displayed image in FIG. 1D. With reference to FIG. 1A, FIG. 1B, FIG. 1D, and FIG. 1E, in the present embodiment, the image to be displayed is assumed to be a horizontal line image, i.e., all of the pixel units PX display the image with the maximum brightness and the minimum brightness row by row in an alternative manner. The operational manner of the source driver 120 and how the gate driver 130 generates the gate driving signals G1 to Gn are similar to those described in the previous embodiment and thus will not be further explained hereinafter.

According to the present embodiment, the pixel units PX corresponding to odd-numbered scan lines (e.g., 141_1 and 141_3) display the maximum brightness, and therefore it is not necessary to adjust the brightness (i.e., the gray-level value) displayed by the pixel units PX corresponding to the odd-numbered scan lines (e.g., 141_1 and 141_3). Hence, the first gray-level control signals (e.g., GCA1 and GCA3) of the pixel units PX corresponding to the odd-numbered scan lines (e.g., 141_1 and 141_3) do not form the positive pulse (i.e., are not enabled).

By contrast, the pixel units PX corresponding to an even-numbered scan line (e.g., 141_2) display the minimum brightness, and therefore the target pixel voltage to be stored in the pixel capacitors CP of the pixel units PX corresponding to the even-numbered scan line (e.g., 141_2) ranges between the maximum gray-level voltage Sout+ and the common voltage Vcom or between the minimum gray-level voltage Sout− and the common voltage Vcom. That is, the first gray-level control signals (e.g., GCA2) of the pixel units PX which are provided by the gate driver 130 and correspond to the even-numbered scan line (e.g., 141_2) form the positive pulse (i.e., the first gray-level control signals (e.g., GCA2) is enabled), so as to turn on the transistors TG of the pixel units PX corresponding to the even-numbered scan line (e.g., 141_2). Moreover, the voltages stored in the pixel capacitors CP may be close to or equal to the target pixel voltage.

In the scan period of the corresponding even-numbered scan lines (e.g., 141_2), the transistors TP of the pixel units PX corresponding to the even-numbered scan lines (e.g., 141_2) may be controlled by the corresponding gate driving signals (e.g., G2) and may then be turned on, so as to transmit the pixel voltages VP to the pixel capacitors CP. At this time, if the transistors TG and the transistors TP of the pixel units PX corresponding to the even-numbered scan lines (e.g., 141_2) are simultaneously turned on, the power consumption of the source driver 120 may increase. Therefore, the transistors TG of the pixel units PX corresponding to the even-numbered scan lines (e.g., 141_2) are turned on in the scan period of the next odd-numbered scan lines (e.g., 141_3). For instance, the exemplary first gray-level control signal GCA2 of the pixel units PX corresponding to the scan line 141_2 is enabled in the scan period of the corresponding scan line 141_3; namely, the first gray-level control signal GCA2 and the gate driving signal G3 are simultaneously enabled.

As described above, in response to the period during which the transistors TG of the pixel units PX corresponding to the even-numbered scan lines (e.g., 141_2) are turned on, the first switch enabling signal SE1 of the timing controller 110 forms negative pulses in the scan periods of the odd-numbered scan lines except for the first scan line (e.g., 141_1), and the first gray-level control signals (e.g., GCA2) of the pixel units PX which are provided by the gate driver 130 and correspond to the even-numbered scan lines (e.g., 141_2) form the positive pulse according to the first switch enabling signal SE1.

In the present embodiment, the increasing or decreasing amplitude of the voltage drops across the pixel capacitors CP is determined by a charging/discharging period (during which the transistor TG is turned on) or charging/discharging speed (i.e., the conducting degree of the transistors TG). Hence, given that the voltage level (e.g., VA) of the first gray-level control signal (e.g., GCA1 to GCA3) is fixed, the enabling period PA of the first gray-level control signal (e.g., GCA1 to GCA3) may be adjusted, so as to change the adjustment amplitude of the voltage drops across the pixel capacitors CP and thereby adjust the brightness (i.e., the gray-level value) displayed by the pixel units PX. The enabling period (e.g., PA) of the first gray-level control signal (e.g., GCA1 to GCA3) is determined by the enabling period (e.g., PS1) of the corresponding negative pulse of the first switch enabling signal SE1; therefore, the timing controller 110 may adjust the brightness (i.e., the gray-level value) displayed by the pixel units PX through adjusting the enabling period (e.g., PS1) of the corresponding negative pulse of the first switch enabling signal SE1.

In another aspect, given that the enabling period (e.g., PA) of the first gray-level control signal (e.g., GCA1 to GCA3) is fixed, the voltage level (e.g., VA) of the first gray-level control signal (e.g., GCA1 to GCA3) may be adjusted, so as to change the adjustment amplitude of the voltage drops across the pixel capacitors CP and thereby adjust the brightness (i.e., the gray-level value) displayed by the pixel units PX. Nonetheless, in other embodiments of the invention, the enabling period (e.g., PA) and/or the voltage level (e.g., VA) of the first gray-level control signal (e.g., GCA1 to GCA3) may be adjusted to change the adjustment amplitude of the voltage drops across the pixel capacitors CP.

Figure 2A:
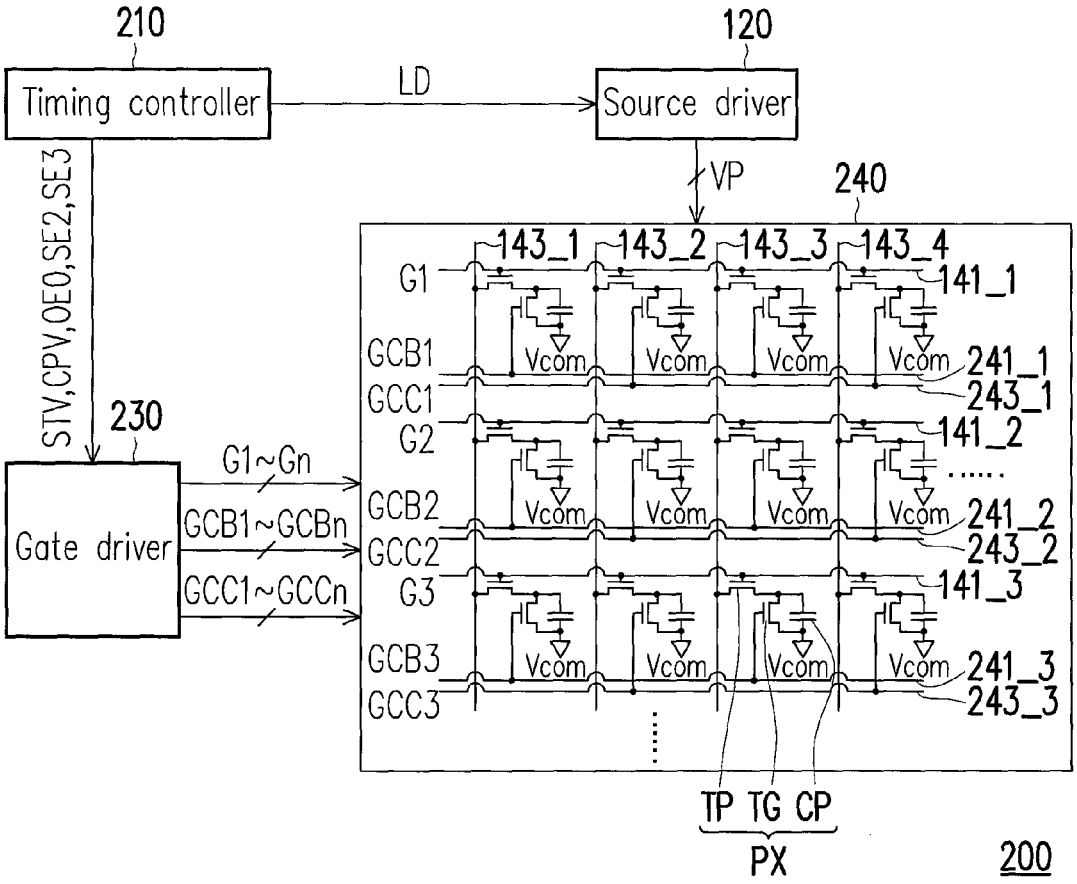
FIG. 2A is a systematic diagram schematically illustrating a display apparatus according to another embodiment of the invention.

FIG. 2A is a systematic diagram schematically illustrating a display apparatus according to another embodiment of the invention. With reference to FIG. 1A and FIG. 2A, the same or similar reference numbers in FIG. 1A and FIG. 2A represent the same or similar elements, while the difference between FIG. 1A and FIG. 2A lies in the timing controller 210, the gate driver 230, and the display panel 240. According to the present embodiment, the gate driver 230 is coupled to the timing controller 210 and the display panel 240. Besides, the gate driver 230 is controlled by a start signal STV, a gate clock signal CPV, and a second switch enabling signal SE2 provided by the timing controller 210 to provide a plurality of second gray-level control signals GCB1 to GCBn, and the gate driver 230 is also controlled by the start signal STV, the gate clock signal CPV, and a third switch enabling signal SE3 provided by the timing controller 210 to provide a plurality of third gray-level control signals GCC1 to GCCn. According to the gate clock signal CPV, the gate driver 230 sets the corresponding second gray-level control signal (e.g., GCB1 to GCBn) with the current and the corresponding third gray-level control signal (e.g., GCC1 to GCCn) with the current. Besides, the gate driver 230 sets the waveform of the corresponding second gray-level control signal (e.g., GCB1 to GCBn) with the current according to the second switch enabling signal SE2, and the gate driver 230 sets the waveform of the corresponding third gray-level control signal (e.g., GCC1 to GCCn) with the current according to the third switch enabling signal SE3.

The display panel 240 further includes a plurality of second gray-level control lines (e.g., 241_1 to 241_3) and a plurality of third gray-level control lines (e.g., 243_1 to 243_3). The second gray-level control lines (e.g., 241_1 to 241_3) are coupled to the gate driver 230, so as to respectively receive the corresponding second gray-level control signals (e.g., GCB1 to GCBn); for instance, the second gray-level control line 241_1 receives the second gray-level control signal GCB1, the second gray-level control line 241_2 receives the second gray-level control signal GCB2, and so forth. The third gray-level control lines (e.g., 243_1 to 243_3) are coupled to the gate driver 230, so as to respectively receive the corresponding third gray-level control signals (e.g., GCC1 to GCCn); for instance, the third gray-level control line 243_1 receives the third gray-level control signal GCC1, the third gray-level control line 243_2 receives the third gray-level control signal GCC2, and so forth.

In the pixel units PX arranged in odd-numbered columns (e.g., the pixel units PX coupled to the data lines 143_1 and 143_3), the gates of the transistors TG are coupled to the corresponding second gray-level control lines (e.g., 241_1 to 241_3), so as to receive the corresponding second gray-level control signals (e.g., GCB1 to GCBn). In the pixel units PX arranged in even-numbered columns (e.g., the pixel units PX coupled to the data lines 143_2 and 143_4), the gates of the transistors TG are coupled to the corresponding third gray-level control lines (e.g., 243_1 to 243_3), so as to receive the corresponding third gray-level control signals (e.g., GCC1 to GCCn).

In the present embodiment, the gates of the transistors TG (corresponding to odd-numbered gray-level switches) of the odd-numbered pixel units PX (e.g., the pixel units PX coupled to the scan lines 143_1 and 143_3) corresponding to the same scan line (e.g., 141_1 to 141_3) are coupled to the same second gray-level control line (e.g., 241_1 to 241_3); therefore, the gates of the transistors TG of the odd-numbered pixel units PX corresponding to the same scan line (e.g., 141_1 to 141_3) receive the same second gray-level control signal (e.g., GCB1 to GCBn). For instance, the gates of the transistors TG of the odd-numbered pixel units PX corresponding to the scan line 141_1 are coupled to the second gray-level control line 241_1 to receive the second gray-level control signal GCB1, the gates of the transistors TG of the odd-numbered pixel units PX corresponding to the scan line 141_2 are coupled to the second gray-level control line 241_2 to receive the second gray-level control signal GCB2, and so forth.

From another perspective, the gates of the transistors TG (corresponding to even-numbered gray-level switches) of the even-numbered pixel units PX corresponding to the same scan line (e.g., 141_1 to 141_3) are coupled to the same third gray-level control line (e.g., 243_1 to 243_3); therefore, the gates of the transistors TG of the even-numbered pixel units PX corresponding to the same scan line (e.g., 141_1 to 141_3) receive the same third gray-level control signal (e.g., GCC1 to GCCn). For instance, the gates of the transistors TG of the even-numbered pixel units PX corresponding to the scan line 141_1 are coupled to the third gray-level control line 243_1 to receive the third gray-level control signal GCC1, the gates of the transistors TG of the even-numbered pixel units PX corresponding to the scan line 141_2 are coupled to the third gray-level control line 243_2 to receive the third gray-level control signal GCC2, and so forth.

As described above, the displayed brightness of the odd-numbered pixel units PX corresponding to the same scan line (e.g., 141_1 to 141_3) is controlled by the same second gray-level control signal (e.g., GCB1 to GCBn) and is adjusted at the same time, and the displayed brightness of the even-numbered pixel units PX corresponding to the same scan line (e.g., 141_1 to 141_3) is controlled by the same third gray-level control signal (e.g., GCC1 to GCCn) and is adjusted at the same time. Namely, in the present embodiment, the odd-numbered or even-numbered pixel units PX corresponding to the same one of the scan lines (e.g., 141_1~141_3) serve as a unit of brightness adjustment.

Figure 2B:
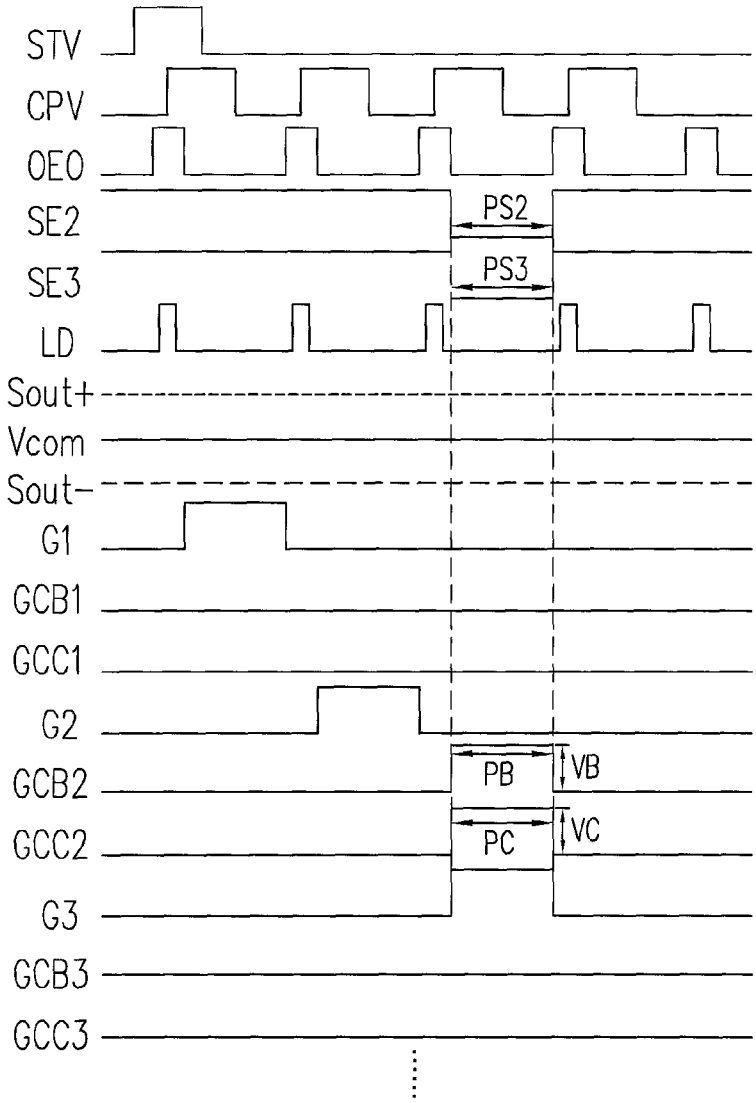
FIG. 2B is a schematic diagram illustrating a driving waveform of the display apparatus depicted in FIG. 2A according to an embodiment of the invention.
Figure 2C:
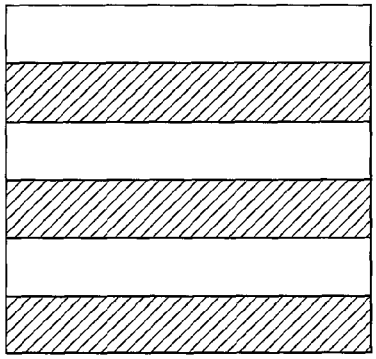
FIG. 2C is a schematic diagram illustrating the displayed image in FIG. 2B.

FIG. 2B is a schematic diagram illustrating a driving waveform of the display apparatus depicted in FIG. 2A according to an embodiment of the invention. FIG. 2C is a schematic diagram illustrating the displayed image in FIG. 2B. With reference to FIG. 1A, FIG. 1B, FIG. 2A, FIG. 2B, and FIG. 2C, descriptions with respect to the start signal STV, the gate clock signal CPV, the output enabling signal OEO, the source data latch signal LD, the maximum gray-level voltage Sout+, the minimum gray-level voltage Sout−, the common voltage Vcom, and the gate driving signals G1 to Gn may be referred to as those provided in the embodiment shown in FIG. 1B and thus will not be further explained hereinafter.

In the present embodiment, the image to be displayed is assumed to be a horizontal line image, i.e., all of the pixel units PX display the image with the maximum brightness and the minimum brightness row by row in an alternative manner. Here, the pixel units PX corresponding to the odd-numbered scan lines (e.g., 141_1 and 141_3) display the image with the maximum brightness, and therefore it is not necessary to adjust the brightness (i.e., the gray-level value) displayed by the pixel units PX corresponding to the odd-numbered scan lines (e.g., 141_1 and 141_3). Hence, the second gray-level control signals (e.g., GCB1 and GCB3) of the pixel units PX arranged in odd-numbered columns and corresponding to the odd-numbered scan lines (e.g., 141_1 and 141_3) do not form the positive pulse (i.e., are not enabled); the third gray-level control signals (e.g., GCC1 and GCC3) of the pixel units PX arranged in even-numbered columns and corresponding to the odd-numbered scan lines (e.g., 141_1 and 141_3) do not form the positive pulse (i.e., are not enabled).

By contrast, the pixel units PX corresponding to even-numbered scan lines (e.g., 141_2) display the minimum brightness; therefore, the target pixel voltage to be stored in the pixel capacitors CP (corresponding to the odd-numbered pixel capacitors) of the pixel units PX arranged in the odd-numbered columns and corresponding to the even-numbered scan lines (e.g., 141_2) ranges between the maximum gray-level voltage Sout+ and the common voltage Vcom or between the minimum gray-level voltage Sout− and the common voltage Vcom; the target pixel voltage to be stored in the pixel capacitors CP (corresponding to the even-numbered pixel capacitors) of the pixel units PX arranged in the even-numbered columns and corresponding to the even-numbered scan lines (e.g., 141_2) ranges between the maximum gray-level voltage Sout+ and the common voltage Vcom or between the minimum gray-level voltage Sout− and the common voltage Vcom.

At this time, the second gray-level control signals (e.g., GCB2) of the pixel units PX which are arranged in the odd-numbered columns, provided by the gate driver 130, and correspond to the even-numbered scan lines (e.g., 141_2) form the positive pulse (i.e., the second gray-level control signals (e.g., GCB2) are enabled), so as to turn on the transistors TG of the pixel units PX which are arranged in the odd-numbered columns and correspond to the even-numbered scan lines (e.g., 141_2). In addition, the third gray-level control signals (e.g., GCC2) of the pixel units PX which are arranged in the even numbered columns, provided by the gate driver 130, and correspond to the even-numbered scan line (e.g., 141_2) form the positive pulse (i.e., the third gray-level control signals (e.g., GCC2) are enabled), so as to turn on the transistors TG of the pixel units PX which are arranged in the even-numbered columns and correspond to the even-numbered scan lines (e.g., 141_2). Thereby, the voltages drops across the pixel capacitors CP of the pixel units PX corresponding to the even-numbered scan lines (e.g., 141_2) may be adjusted, and the voltages stored in the pixel capacitors CP may be close to or equal to the target pixel voltage.

To be specific, the second switch enabling signal SE2 and the third switch enabling signal SE3 of the timing controller 210 form negative pulses in the scan periods of the odd-numbered scan lines except for the first scan line (e.g., 141_1), the second gray-level control signals (e.g., GCB2) of the pixel units PX which are arranged in the odd-numbered columns, provided by the gate driver 130, and correspond to the even-numbered scan lines (e.g., 141_2) form the positive pulse according to the second switch enabling signal SE2, and the third gray-level control signals (e.g., GCC2) of the pixel units PX which are arranged in the even-numbered columns, provided by the gate driver 130, and correspond to the even-numbered scan lines (e.g., 141_2) form the positive pulse according to the third switch enabling signal SE3. For instance, in the exemplary pixel units PX corresponding to the scan line 141_2, the second switch enabling signal SE2 and the third switch enabling signal SE3 form the negative pulse in the scan period of the corresponding scan line 141_3, such that the gate driving signal G3, the second gray-level control signal GCB2, and the third gray-level control signal GCC2 together form the positive pulse (i.e., the gate driving signal G3, the second gray-level control signal GCB2, and the third gray-level control signal GCC2 are simultaneously enabled). Thereby, the power consumption of the source driver 120 may be economized.

In the present embodiment, the increasing or decreasing amplitude of the voltage drops across the pixel capacitors CP is determined by a charging/discharging period (during which the transistor TG is turned on) or charging/discharging speed (i.e., the conducting degree of the transistor TG). Hence, given that the voltage level (e.g., VB) of the second gray-level control signal (e.g., GCB1 to GCB3) is fixed, the enabling period (e.g., PB) of the second gray-level control signal (e.g., GCB1 to GCB3) may be adjusted, so as to change the adjustment amplitude of the voltage drops across the pixel capacitors CP of the pixel units PX arranged in the odd-numbered columns and thereby adjust the brightness (i.e., the gray-level value) displayed by the pixel units PX arranged in the odd-numbered columns. The enabling period (e.g., PB) of the second gray-level control signal (e.g., GCB1 to GCB3) is determined by the enabling period (e.g., PS2) of the corresponding negative pulse of the second switch enabling signal SE2; therefore, the timing controller 210 may adjust the brightness (i.e., the gray-level value) displayed by the pixel units PX arranged in the odd-numbered columns through adjusting the enabling period (e.g., PS2) of the corresponding negative pulse of the second switch enabling signal SE2.

Alternatively, given that the enabling period (e.g., PB) of the second gray-level control signal (e.g., GCB1 to GCB3) is fixed, the voltage level (e.g., VB) of the second gray-level control signal (e.g., GCB1 to GCB3) may be adjusted, so as to change the adjustment amplitude of the voltage drops across the pixel capacitors CP of the pixel units PX arranged in the odd-numbered columns and thereby adjust the brightness (i.e., the gray-level value) displayed by the pixel units PX arranged in the odd-numbered columns. Nonetheless, in other embodiments of the invention, the enabling period (e.g., PB) and/or the voltage level (e.g., VB) of the second gray-level control signal (e.g., GCB1 to GCB3) may be adjusted to change the adjustment amplitude of the voltage drops across the pixel capacitors CP of the pixel units PX arranged in the odd-numbered columns.

On the other hand, given that the voltage level (e.g., VC) of the third gray-level control signal (e.g., GCC1 to GCC3) is fixed, the enabling period (e.g., PC) of the third gray-level control signal (e.g., GCC1 to GCC3) may be adjusted, so as to change the adjustment amplitude of the voltage drops across the pixel capacitors CP of the pixel units PX arranged in the even-numbered columns and thereby adjust the brightness (i.e., the gray-level value) displayed by the pixel units PX arranged in the even-numbered columns. The enabling period (e.g., PC) of the third gray-level control signal (e.g., GCC1 to GCC3) is determined by the enabling period (e.g., PS3) of the corresponding negative pulse of the third switch enabling signal SE3; therefore, the timing controller 210 may adjust the brightness (i.e., the gray-level value) displayed by the pixel units PX arranged in the even-numbered columns through adjusting the enabling period (e.g., PS3) of the corresponding negative pulse of the third switch enabling signal SE3.

Alternatively, given that the enabling period (e.g., PC) of the third gray-level control signal (e.g., GCC1 to GCC3) is fixed, the voltage level (e.g., VC) of the third gray-level control signal (e.g., GCC1 to GCC3) may be adjusted, so as to change the adjustment amplitude of the voltage drops across the pixel capacitors CP of the pixel units PX arranged in the even-numbered columns and thereby adjust the brightness (i.e., the gray-level value) of the image displayed by the pixel units PX arranged in the even-numbered columns. Nonetheless, in other embodiments of the invention, the enabling period (e.g., PC) and/or the voltage level (e.g., VC) of the third gray-level control signal (e.g., GCC1 to GCC3) may be adjusted to change the adjustment amplitude of the voltage drops across the pixel capacitors CP of the pixel units PX arranged in the even-numbered columns.

Figure 2D:
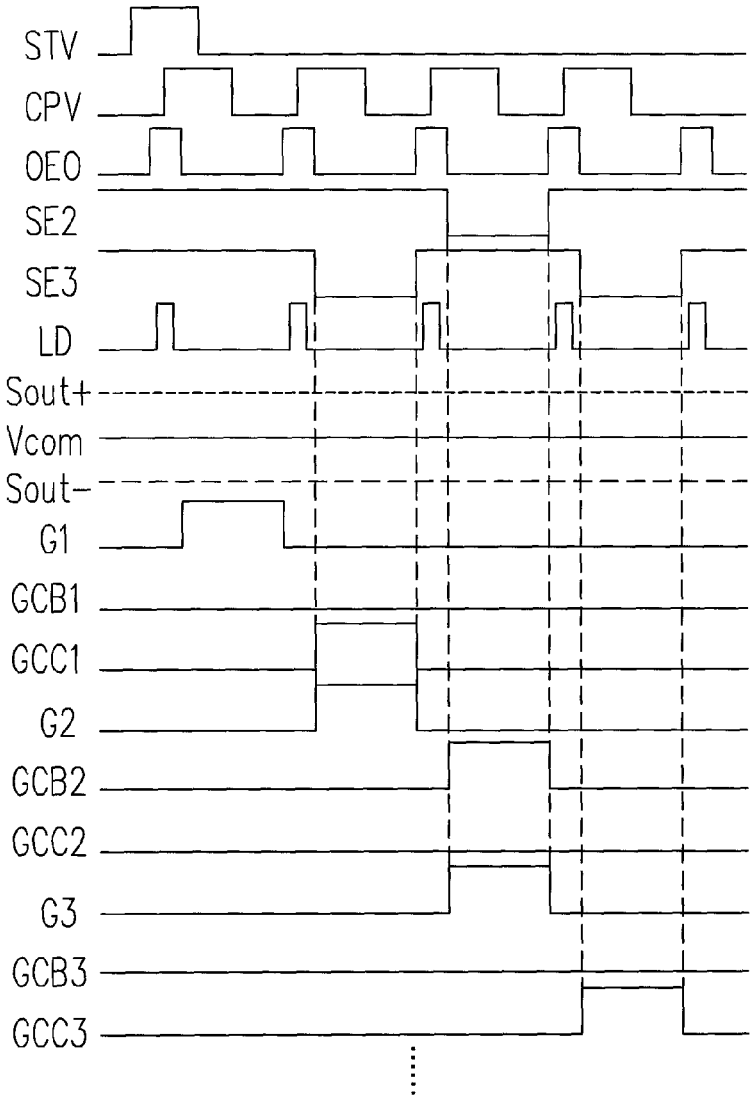
FIG. 2D is a schematic diagram illustrating a driving waveform of the display apparatus depicted in FIG. 2A according to another embodiment of the invention.
Figure 2E:
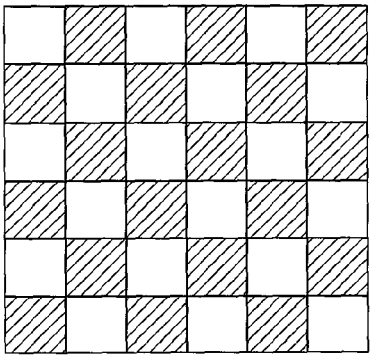
FIG. 2E is a schematic diagram illustrating the displayed image in FIG. 2D.

FIG. 2D is a schematic diagram illustrating a driving waveform of the display apparatus depicted in FIG. 2A according to another embodiment of the invention. FIG. 2E is a schematic diagram illustrating the displayed image in FIG. 2D. With reference to FIG. 2A, FIG. 2B, FIG. 2D, and FIG. 2E, in the present embodiment, the image to be displayed is assumed to be a chessboard-like image with alternate lightness and darkness. In particular, the pixel units PX that are arranged in the odd-numbered columns and correspond to the odd-numbered scan lines (e.g., 141_1 and 141_3) and the pixel units PX that are arranged in the even-numbered columns and correspond to the even-numbered scan lines (e.g., 141_2) display the maximum brightness, and therefore it is not necessary to adjust the brightness (i.e., the gray-level value) displayed by the pixel units PX that are arranged in the odd-numbered columns and correspond to the odd-numbered scan lines (e.g., 141_1 and 141_3) and the pixel units PX that are arranged in the even-numbered columns and correspond to the even-numbered scan lines (e.g., 141_2). Hence, the second gray-level control signals (e.g., GCB1 and GCB3) of the pixel units PX arranged in odd-numbered columns and corresponding to the odd-numbered scan lines (e.g., 141_1 and 141_3) do not form the positive pulse (i.e., are not enabled), and the third gray-level control signals (e.g., GCC2) of the pixel units PX arranged in even-numbered columns and corresponding to the even-numbered scan lines (e.g., 141_2) does not form the positive pulse (i.e., is not enabled).

By contrast, the pixel units PX that are arranged in the even-numbered columns and correspond to the odd-numbered scan lines (e.g., 141_1 and 141_3) and the pixel units PX that are arranged in the odd-numbered columns and correspond to the even-numbered scan lines (e.g., 141_2) display the minimum brightness; therefore, the target pixel voltage to be stored in the pixel capacitors CP of the pixel units PX arranged in the even-numbered columns and corresponding to the odd-numbered scan lines (e.g., 141_1 and 141_3) ranges between the maximum gray-level voltage Sout+ and the common voltage Vcom or between the minimum gray-level voltage Sout− and the common voltage Vcom; the target pixel voltage to be stored in the pixel capacitors CP of the pixel units PX arranged in the odd-numbered columns and corresponding to the even-numbered scan line (e.g., 141_2) ranges between the maximum gray-level voltage Sout+ and the common voltage Vcom or between the minimum gray-level voltage Sout− and the common voltage Vcom.

At this time, the third gray-level control signals (e.g., GCC1 and GCC3) of the pixel units PX which are arranged in the even-numbered columns, provided by the gate driver 130, and correspond to the odd-numbered scan lines (e.g., 141_1 and 141_3) form the positive pulse (i.e., the third gray-level control signals (e.g., GCC1 and GCC3) are enabled), so as to turn on the transistors TG of the pixel units PX which are arranged in the even-numbered columns and correspond to the odd-numbered scan lines (e.g., 141_1 and 141_3); the second gray-level control signals (e.g., GCB2) of the pixel units PX which are arranged in the odd-numbered columns, provided by the gate driver 130, and correspond to the even-numbered scan lines (e.g., 141_2) form the positive pulse (i.e., the second gray-level control signals (e.g., GCB2) is enabled), so as to turn on the transistors TG of the pixel units PX which are arranged in the odd-numbered columns and correspond to the even-numbered scan lines (e.g., 141_2). Thereby, the voltages drops across the pixel capacitors CP of the pixel units PX which are arranged in the even-numbered columns and correspond to the odd-numbered scan lines (e.g., 141_1 and 141_3) and the voltage drops across the pixel capacitors CP of the pixel units PX which are arranged in the odd-numbered columns and correspond to the even-numbered scan lines (e.g., 141_2) may be adjusted, and the voltages stored in the pixel capacitors CP may be close to or equal to the target pixel voltage.

As described above, the second switch enabling signal SE2 of the timing controller 210 form negative pulses in the corresponding scan periods of the odd-numbered scan lines (e.g., 141_3) except for the first scan line (e.g., 141_1), and the second gray-level control signals (e.g., GCB2) of the pixel units PX which are arranged in the odd-numbered columns, provided by the gate driver 230, and correspond to the even-numbered scan lines (e.g., 141_2) form the positive pulse (i.e., is enabled) according to the second switch enabling signal SE2. Besides, the third switch enabling signal SE3 form negative pulse in the corresponding scan periods of the even-numbered scan lines (e.g., 141_2), and third second gray-level control signals (e.g., GCC1 and GCC3) of the pixel units PX which are arranged in the even-numbered columns, provided by the gate driver 230, and correspond to the odd-numbered scan lines (e.g., 141_1 and 141_3) form the positive pulse (i.e., are enabled) according to the third switch enabling signal SE3.

In addition, according to the previous embodiment, the pixel units PX that are arranged in one entire row (i.e. correspond to one scan line) serve as a unit of brightness adjustment, or the pixel units PX that are arranged in one entire row and in odd-numbered or even-numbered columns (i.e. the pixel units PX are arranged in odd-numbered or even-numbered columns and correspond to one scan line) serve as a unit of brightness adjustment. Therefore, simple images may be displayed. However, in other embodiments of the invention, the unit of brightness adjustment may be different from those described above, and one pixel unit PX may serve as a unit of brightness adjustment. This may be determined according to the design requirement for the display panel.

To sum up, each pixel unit in the display apparatus described in an embodiment of the invention is equipped with the transistor (corresponding to the gray-level switch) coupled to the pixel capacitor in parallel, and each transistor is controlled by the corresponding gray-level control signal and is turned on. Thereby, the voltage levels stored by the pixel capacitors coupled to the gray-level switches may be adjusted. Namely, the brightness displayed by each pixel unit may be adjusted according to whether the transistor coupled to the pixel capacitor in parallel is turned on or not. Besides, the pixel voltages provided by the source driver may be kept at the maximum gray-level voltage or the minimum gray-level voltage, so as to reduce the power consumption of the source driver and further reduce the power consumption of the display apparatus.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A display apparatus comprising:

a source driver providing a plurality of pixel voltages, wherein the pixel voltages respectively correspond to either a maximum gray-level voltage or a minimum gray-level voltage, and the maximum gray-level voltage and the minimum gray-level voltage correspond to a same gray-level value and have different polarities; and a display panel comprising:

a plurality of data lines coupled to the source driver to receive the pixel voltages;

a plurality of pixel switches, each of the pixel switches being respectively coupled to a corresponding data line of the data lines to transmit a corresponding pixel voltage of the pixel voltages;

a plurality of pixel capacitors, each of the pixel capacitors being respectively coupled between a corresponding pixel switch of the pixel switches and a common voltage to receive the corresponding pixel voltage; and a plurality of gray-level switches, each of the gray-level switches being respectively coupled to a corresponding pixel capacitor of the pixel capacitors in parallel, each of the gray-level switches respectively receiving a gray-level control signal, the gray-level switches regulating voltage drops across the pixel capacitors coupled to the gray-level switches in parallel according to the corresponding gray-level control signals, wherein, when the source driver drives the display panel by a frame inversion, the pixel voltage applied to all the pixels is the maximum gray-level voltage during a first frame period and is the minimum gray-level voltage during a second frame period, adjacent to the first frame period;

when the source driver drives the display panel by a column inversion, the pixel voltage applied to all the pixels in a first column is the maximum gray-level voltage and the pixel voltage applied to all the pixels in a second column, adjacent to the first column, is the minimum gray-level voltage.

2. The display apparatus as recited in claim 1, wherein each of the gray-level control signals is enabled by a target pixel voltage of a corresponding pixel capacitor of the pixel capacitors, and the target pixel voltage ranges between the maximum gray-level voltage and the common voltage or between the minimum gray-level voltage and the common voltage.

3. The display apparatus as recited in claim 1, wherein adjustment amplitude of each of the voltage drops across the pixel capacitors is determined by a voltage level and an enabling period of the corresponding gray-level control signals.

4. The display apparatus as recited in claim 1, wherein the display panel further comprises a plurality of scan lines respectively coupled to the pixel switches.

5. The display apparatus as recited in claim 4, wherein the gray-level control signals received by the gray-level switches corresponding to the same one of the scan lines correspond to a first gray-level control signal.

6. The display apparatus as recited in claim 4, wherein the gray-level control signals received by odd-numbered gray-level switches of the gray-level switches corresponding to the same one of the scan lines correspond to a second gray-level control signals, and the gray-level control signals received by even-numbered gray-level switches of the gray-level switches corresponding to the same one of the scan lines correspond to a third gray-level control signals.

7. The display apparatus as recited in claim 1, wherein the pixel switches and the gray-level switches are transistors.

8. A display apparatus comprising:

a timing controller outputting a source data latch signal;

a source driver coupled to the timing controller, the source driver providing a plurality of pixel voltages according to the source data latch signal, wherein the pixel voltages respectively correspond to either a maximum gray-level voltage or a minimum gray-level voltage, and the maximum gray-level voltage and the minimum gray-level voltage correspond to a same gray-level value and have different polarities; and a display panel comprising:

a plurality of data lines coupled to the source driver to receive the pixel voltages;

a plurality of pixel switches, each of the pixel switches being respectively coupled to a corresponding data line of the data lines to transmit a corresponding pixel voltage of the pixel voltages;

a plurality of pixel capacitors, each of the pixel capacitors being respectively coupled between a corresponding pixel switch of the pixel switches and a common voltage to receive the corresponding pixel voltage; and a plurality of gray-level switches, each of the gray-level switches being respectively coupled to a corresponding pixel capacitor of the pixel capacitors in parallel, each of the gray-level switches respectively receiving a gray-level control signal, the gray-level switches regulating voltage drops across the pixel capacitors coupled to the gray-level switches in parallel according to the corresponding gray-level control signal, wherein, when the source driver drives the display panel by a frame inversion, the pixel voltage applied to all the pixels is the maximum gray-level voltage during a first frame period and is the minimum gray-level voltage during a second frame period, adjacent to the first frame period;

when the source driver drives the display panel by a column inversion, the pixel voltage applied to all the pixels in a first column is the maximum gray-level voltage and the pixel voltage applied to all the pixels in a second column, adjacent to the first column, is the minimum gray-level voltage.

9. The display apparatus as recited in claim 8, further comprising a gate driver coupled to the timing controller, the gate driver being controlled by the timing controller to provide a plurality of gate driving signals, so as to drive the pixel switches row by row to transmit the corresponding pixel voltages, the gate driver being controlled by the timing controller to provide the gray-level control signals.

10. The display apparatus as recited in claim 9, wherein the display panel further comprises a plurality of scan lines respectively coupled between the gate driver and the pixel switches, so as to respectively transmit the gate driving signals to the pixel switches.

11. The display apparatus as recited in claim 10, wherein the gray-level control signals received by the gray-level switches corresponding to the same one of the scan lines correspond to a first gray-level control signal.

12. The display apparatus as recited in claim 11, wherein when target pixel voltages of the pixel capacitors corresponding to the same one of the scan lines all range between the maximum gray-level voltage and the common voltage or between the minimum gray-level voltage and the common voltage, the timing controller controls the gate driver to enable the first gray-level control signal of the gray-level switches corresponding to the current one of the scan lines.

13. The display apparatus as recited in claim 12, wherein the first gray-level control signal of the gray-level switches corresponding to the current one of the scan lines are enabled in a scan period corresponding to a next one of the scan lines.

14. The display apparatus as recited in claim 12, wherein adjustment amplitude of the voltage drops across the pixel capacitors corresponding to the current one of the scan lines is determined by a voltage level and an enabling period of the corresponding first gray-level control signal.

15. The display apparatus as recited in claim 12, wherein the gate driver enables the first gray-level control signals according to a first switch enabling signal provided by the timing controller.

16. The display apparatus as recited in claim 10, wherein the gray-level control signals received by odd-numbered gray-level switches of the gray-level switches corresponding to the same one of the scan lines correspond to a second gray-level control signals, and the gray-level control signals received by even-numbered gray-level switches of the gray-level switches corresponding to the same one of the scan lines correspond to a third gray-level control signals.

17. The display apparatus as recited in claim 16, wherein when target pixel voltages of odd-numbered pixel capacitors of the pixel capacitors corresponding to current one of the scan lines all range between the maximum gray-level voltage and the common voltage or between the minimum gray-level voltage and the common voltage, the timing controller controls the gate driver to enable the second gay-level control signal of the odd-numbered gray-level switches corresponding to the current one of the scan lines.

18. The display apparatus as recited in claim 17, wherein the second gray-level control signal of the odd-numbered gray-level switches corresponding to the current one of the scan lines are enabled in a scan period corresponding to a next one of the scan lines.

19. The display apparatus as recited in claim 17, wherein adjustment amplitude of the voltage drops across the odd-numbered pixel capacitors corresponding to the current one of the scan lines is determined by a voltage level and an enabling period of the corresponding second gray-level control signal.

20. The display apparatus as recited in claim 17, wherein the gate driver enables the second gray-level control signals according to a second switch enabling signal provided by the timing controller.

21. The display apparatus as recited in claim 16, wherein when target pixel voltages of even-numbered pixel capacitors of the pixel capacitors corresponding to the current one of the scan lines all range between the maximum gray-level voltage and the common voltage or between the minimum gray-level voltage and the common voltage, the timing controller controls the gate driver to enable the third gray-level control signal of the even-numbered gray-level switches corresponding to the current one of the scan lines.

22. The display apparatus as recited in claim 21, wherein the third gray-level control signal of the even-numbered gray-level switches corresponding to the current one of the scan lines are enabled in a scan period corresponding to a next one of the scan lines.

23. The display apparatus as recited in claim 21, wherein adjustment amplitude of the voltage drops across the even-numbered pixel capacitors corresponding to the current one of the scan lines is determined by a voltage level and an enabling period of the corresponding third gray-level control signal.

24. The display apparatus as recited in claim 21, wherein the gate driver enables the third gray-level control signals according to a third switch enabling signal provided by the timing controller.

25. The display apparatus as recited in claim 9, wherein the gate driver provides the gate driving signals according a start signal, a gate clock signal, and an output enabling signal provided by the timing controller.

26. The display apparatus as recited in claim 8, wherein the pixel switches and the gray-level switches are transistors.

27. A display panel, comprising:

a plurality of data lines, respectively receiving either a maximum gray-level voltage or a minimum gray-level voltage, wherein the maximum gray-level voltage and the minimum gray-level voltage correspond to a same gray-level value and have different polarities;

a plurality of pixel switches, each of the pixel switches being respectively coupled to a corresponding data line of the data lines;

a plurality of pixel capacitors, each of the pixel capacitors being respectively coupled between a corresponding pixel switch of the pixel switches and a common voltage; and a plurality of gray-level switches, each of the gray-level switches being respectively coupled to a corresponding pixel capacitor of the pixel capacitors in parallel, wherein, when the source driver drives the display panel by a frame inversion, the pixel voltage applied to all the pixels is the maximum gray-level voltage during a first frame period and is the minimum gray-level voltage during a second frame period, adjacent to the first frame period;

when the source driver drives the display panel by a column inversion, the pixel voltage applied to all the pixels in a first column is the maximum gray-level voltage and the pixel voltage applied to all the pixels in a second column, adjacent to the first column, is the minimum gray-level voltage.

28. The display panel as recited in claim 27, wherein each of the gray-level switches receives a gray-level control signal and regulates a voltage drop across the corresponding pixel capacitor according to corresponding gray-level control signals, respectively.

* * * * *